US007121689B2

(12) United States Patent
Fowler, Jr.

(10) Patent No.: US 7,121,689 B2
(45) Date of Patent: Oct. 17, 2006

(54) LIGHTING FIXTURE HAVING SPRING MOUNTED LOUVERS

(75) Inventor: Wilton L. Fowler, Jr., Veradale, WA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/007,800

(22) Filed: Dec. 9, 2004

(65) Prior Publication Data

US 2006/0126337 A1 Jun. 15, 2006

(51) Int. Cl.
*F21V 11/02* (2006.01)
*F21V 17/18* (2006.01)
*F21S 4/00* (2006.01)

(52) U.S. Cl. ..... 362/290; 362/374; 362/433

(58) Field of Classification Search ..... 362/290–292, 362/325, 342, 354, 374, 375, 433, 225
See application file for complete search history.

(56) References Cited

U.S. PATENT DOCUMENTS 2,794,664 A * 6/1957 Kruger ..... 362/374
2,852,663 A * 9/1958 Stuffer et al. ..... 362/354
2,912,568 A * 11/1959 Winkler ..... 362/375
3,004,147 A * 10/1961 Lessner et al. ..... 362/374
3,078,366 A * 2/1963 Winkler ..... 362/223
5,025,355 A * 6/1991 Harwood ..... 362/374
5,806,972 A * 9/1998 Kaiser et al. ..... 362/290
5,908,234 A 6/1999 Kreeft
6,390,654 B1 5/2002 Diaz et al.
6,439,741 B1 8/2002 Diaz et al.
6,523,982 B1 2/2003 Haddad

FOREIGN PATENT DOCUMENTS

DE 3611813 4/1986

* cited by examiner

*Primary Examiner*—Alan Cariaso
(74) *Attorney, Agent, or Firm*—Marcus R. Mickney; Alfred N. Goodman; Mark S. Bicks

(57) ABSTRACT

A lighting fixture is provided having an easily and efficiently installable and removable louver assembly. The lighting fixture has a housing that has a first wall and a second wall and an opening between the first and second walls. At least one spring latch is connected to the housing. A louver assembly has a plurality of louver blades. A first end of the plurality of louver blades is attached to a first arm and a second end of the plurality of louver blades is attached to a second arm. The first arm is connected to the first housing wall and the second arm is secured between the second housing wall and the at least one spring latch.

23 Claims, 5 Drawing Sheets

LIGHTING FIXTURE HAVING SPRING MOUNTED LOUVERS

FIELD OF THE INVENTION

The present invention relates to an electrical lighting fixture having spring mounted louvers. More specifically, the present invention relates to an electrical lighting fixture having a louver assembly secured to a luminaire housing by a spring latch. Still more particularly, the present invention relates to a fluorescent luminaire fixture having a louver assembly pivotally connected to a luminaire housing on a first side and spring-mounted to the housing on the second side. The louver assembly is installed to and removed from the fluorescent luminaire fixture housing without tools, thereby providing quick and efficient installation and removal.

BACKGROUND OF THE INVENTION

Conventional lighting fixtures for retail and industrial applications often have louvers that are rigidly fastened to the lighting fixture housing. Such installation of the louvers for conventional lighting fixtures requires multiple steps including installing several fasteners through the louvers and into the housing. This installation procedure is slow and inefficient, by requiring an installer to insert numerous fasteners at several locations to secure the louvers to the lighting fixture housing. Additionally, an installer must ensure he has sufficient fasteners to completely secure the louvers to the lighting fixture housing. A need exists for a lighting fixture having a louver assembly that is more easily and efficiently connected to the lighting fixture housing.

Once the louvers are installed, access to the interior of the lighting fixture is prevented by the louver blades. To access the lighting fixture interior, the louvers must be removed from the housing. This is time consuming since there are numerous fasteners that must be removed to detach the louvers from the housing. Furthermore, louvers are secured by fasteners on both sides of the louvers, thereby requiring the installer to remove numerous fasteners to detach the louvers. The removal process is extremely time consuming and inefficient. A need exists for a louver assembly that is quickly and efficiently installed and removed from a lighting fixture.

Another problem with existing louvers is that the installer must use tools to install and remove the louvers. If the installer has no tools or the incorrect tools, then the louvers cannot be installed to or removed from the lighting fixture. Thus, the lighting fixture cannot be completely installed or maintenance on the lighting fixture cannot be performed until the installer has the proper tools. A need exists for a louver assembly that is securable to and removable from a lighting fixture without requiring tools.

Examples of conventional lighting fixtures include U.S. Pat. No. 5,980,234 to Kreeft, U.S. Pat. No. 6,390,654 to Diaz et al., and U.S. Pat. No. 6,390,654 to Diaz et al., the subject matter of each of which is hereby incorporated by reference.

A need exists for an improved lighting fixture having an easily installed and removed louver assembly.

SUMMARY OF THE INVENTION

Accordingly, an object of the present invention is to provide a lighting fixture having a louver assembly that is easily installed to and removed from a housing of the lighting fixture.

Another object of the present invention is to provide a louver assembly for a lighting fixture that is installable and removable without the use of tools.

The foregoing objects are basically attained by providing a lighting fixture, including a housing having a first wall and second wall and an opening between the first and second walls; at least one spring latch connected to the housing; and a louver assembly having a plurality of louver blades, a first end of said plurality of louver blades being attached to a first arm and a second end of said plurality of louver blades being attached to a second arm, the first arm being connected to the first housing wall and the second arm being secured between the second housing wall and the at least one spring latch. The spring latch allows the louver assembly to easily and efficiently installed to and removed from the lighting fixture housing.

The foregoing objects are also attained by a method of securing a louver assembly to a lighting fixture, including the steps of hooking a first arm of the louver assembly to a first wall of a housing of the lighting fixture; pivoting the louver assembly upwardly; contacting a latch spring connected to the housing with a second arm of the louver assembly; and securing the second arm of the louver assembly to the housing by continuing upward pivoting of the louver assembly until the second arm of the louver assembly until the second arm is positioned between a second wall of the housing and the spring latch.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
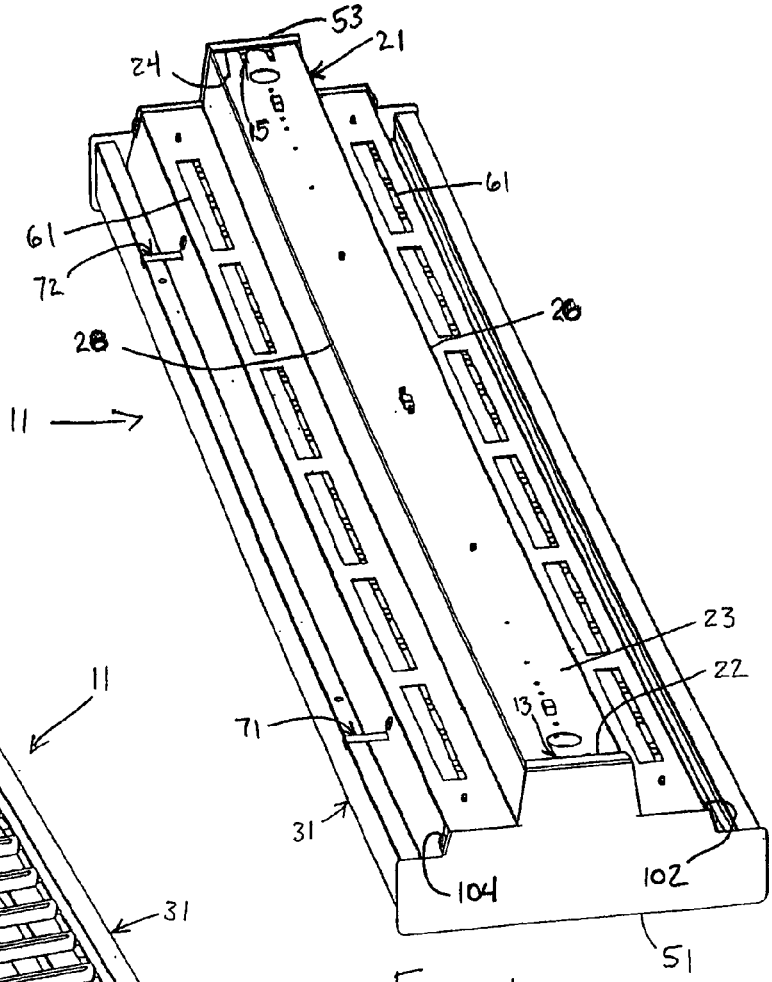
FIG. 1 is a perspective view of a lighting fixture in accordance with the present invention, showing a louver assembly secured to a housing by a latch spring.
Figure 2:
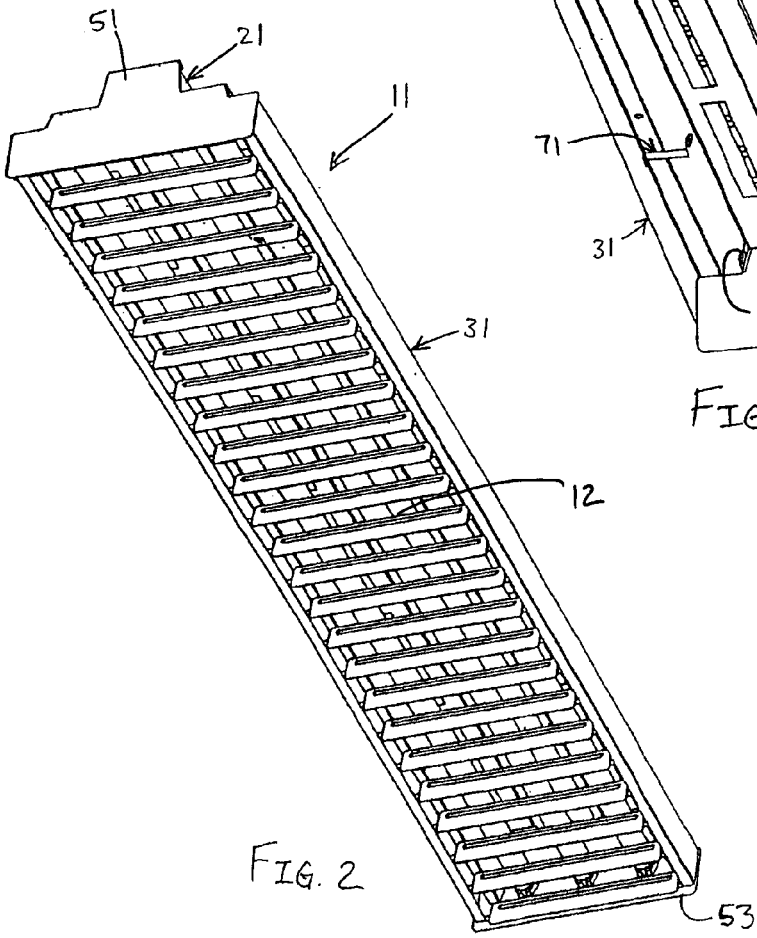
FIG. 2 is a perspective view of the lighting fixture of FIG. 1, showing a louver assembly having a plurality of louver blades.
Figure 3:
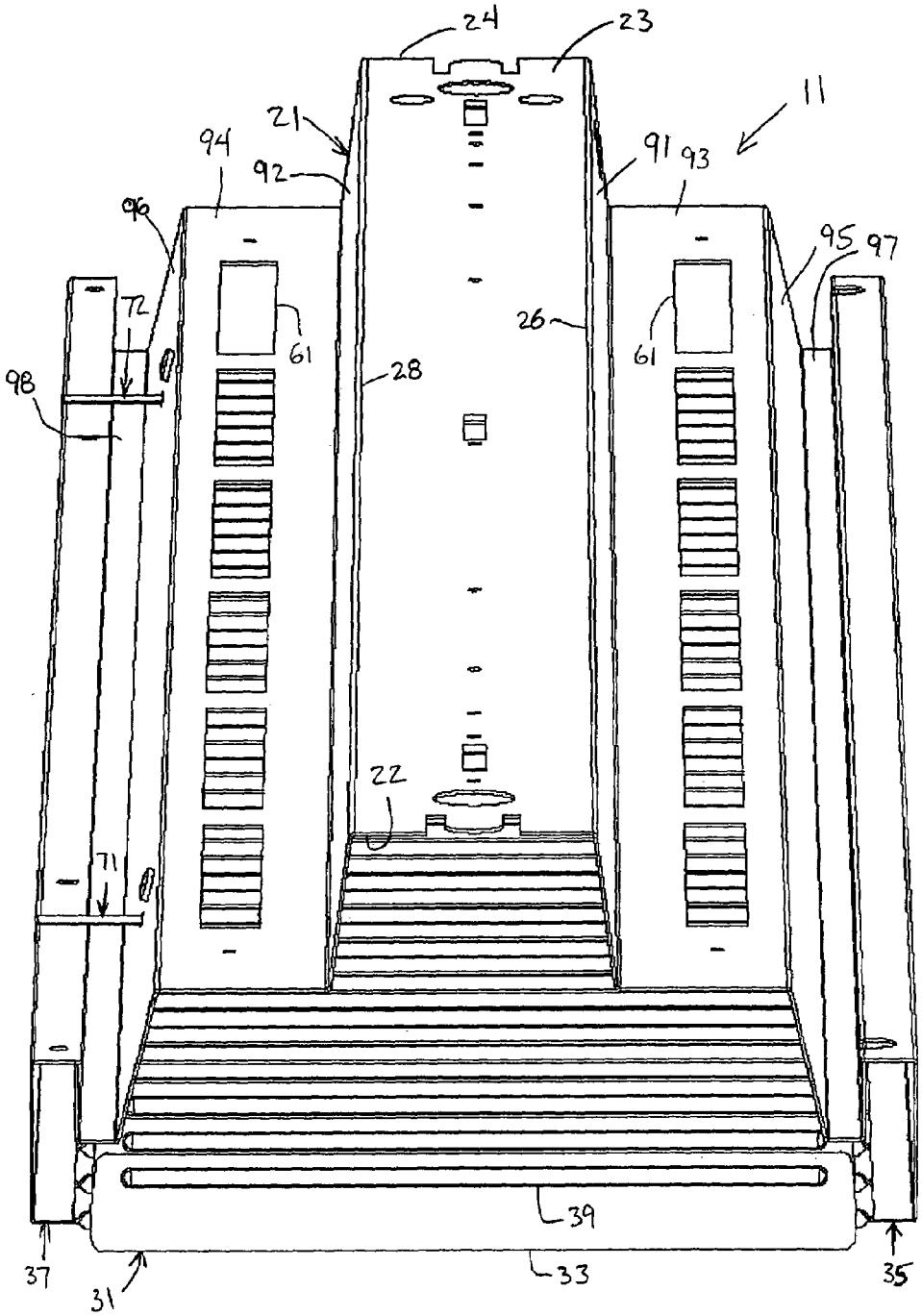
FIG. 3 is a perspective view of a housing and louver assembly of the lighting fixture of FIG. 1.

Referring to FIGS. 1–9, a lighting fixture 11 in accordance with the present invention generally includes a housing 21 that receives a louver assembly 31 and lamps 41, 43, and 45. Preferably, the lamps 41, 43 and 45 are fluorescent. The lighting fixture 11 may be suspended from a support, such as a ceiling or beam, by a suspension assembly. A suitable suspension assembly is disclosed in U.S. patent Ser. No. 10/815,993 for an "Electrical Lighting Fixture with Suspension Assembly" to Brondt et al., filed Apr. 2, 2004, which is hereby incorporated by reference in its entirety.

As shown in FIGS. 1–4, the lighting fixture has an elongated housing 21. A top wall 23 of the housing 21 has a first end 22 and a second end 24. A first wall 25 and a second wall 27 are connected to a first edge 26 and a second edge 28 of the top wall 23, respectively. In one embodiment of the present invention, as shown in FIGS. 3–5 and 7–9, a series of stepped walls extend between the first and second edges 26 and 28 and the first and second walls 25 and 27, respectively. Wall member 91 extends downwardly from the first edge 26 of the top wall 23. Wall member 93 extends outwardly from wall member 91. Wall member 95 extends downwardly from wall member 93. Wall member 97 extends outwardly from wall member 95. First wall 25 extends upwardly from wall member 97. Wall member 92 extends downwardly from the second edge 28 of the top wall 23. Wall member 94 extends outwardly from wall member 92. Wall member 96 extends downwardly from wall member 94. Wall member 98 extends outwardly from wall member 96. Second wall 27 extends upwardly from wall member 96. Preferably, first and second walls 25 and 27 extend upwardly substantially perpendicularly from wall member 97 and 98, respectively. Preferably, the housing is made of steel and unitarily formed.

Figure 6:
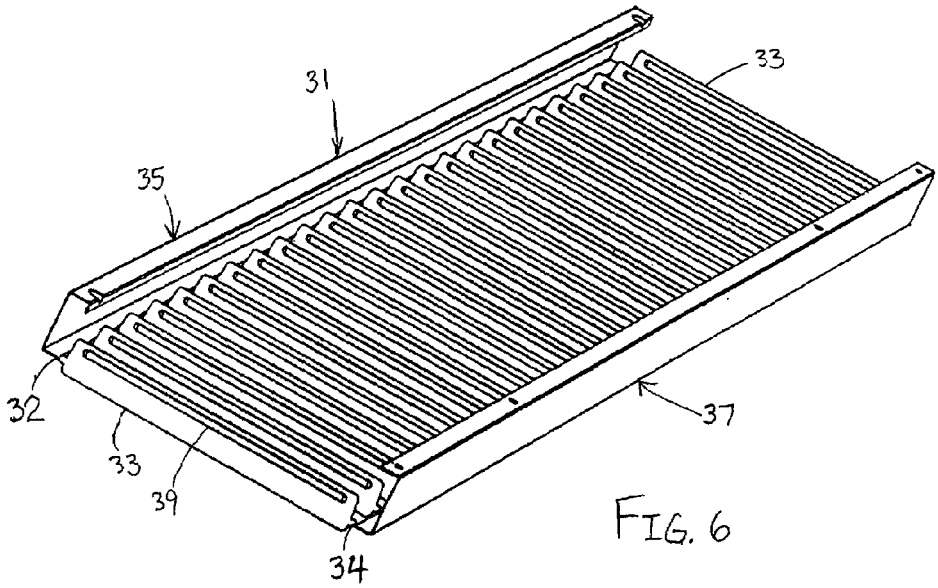
FIG. 6 is a perspective view of the louver assembly of FIG. 1.

The louver assembly 31 has a plurality of louver blades 33, as shown in FIGS. 1 and 6. Preferably, the louver blades 33 are substantially identical to one another. A first arm 35 extends outwardly from a first end 32 of the louver blades 33. A second arm 37 extends outwardly from a second end 34 of the louver blades 33. Preferably, the first and second arms 35 and 37 extend outwardly in opposite directions. A stiffening rib 39 extends across each louver blade 33 to strengthen the louver blade and prevent flexing and deformation of the blade. The louvers are preferably made of steel, and treated with a high reflectance precoat white finish. Preferably, the louver assembly 31 is unitarily formed.

The first louver arm 35 is adapted to be connected to the first wall 25 of the housing 21. A hook 81 is formed at a distal end of the first louver arm 35, as shown in FIGS. 6–9. Preferably, the hook 81 has a first leg 82, second leg 83 and third leg 84. Preferably, the first leg is 82 substantially perpendicular to the second leg 83, which is substantially perpendicular to the third leg 84, thereby forming a hook 81 that is adapted to be pivotally connected to the first wall 25 of the housing 21. A fourth leg 85 may extend outwardly from the first end 32 of the blades 33 to connect the third leg 83 of the hook 81 to the blades 33. The hook 81 allows the first louver arm 35 to be pivotally connected to an upper surface 16 of the first housing wall 25.

The second louver arm 37 is adapted to be secured to the second wall 27 of the housing 21 by at least one spring latch 71. Preferably, the second louver arm 37 has a third leg 88 extending outwardly from the second end 34 of the louver blades 33. A second leg 87 extends upwardly from the third leg 88. A first leg 86 extends inwardly from the second leg 87. Preferably, the first leg 86 is substantially perpendicular to the second leg 87, which is substantially perpendicular to the third leg 88. The first leg 86 is adapted to be received on an upper surface 18 of the second housing wall 27.

Figure 4:
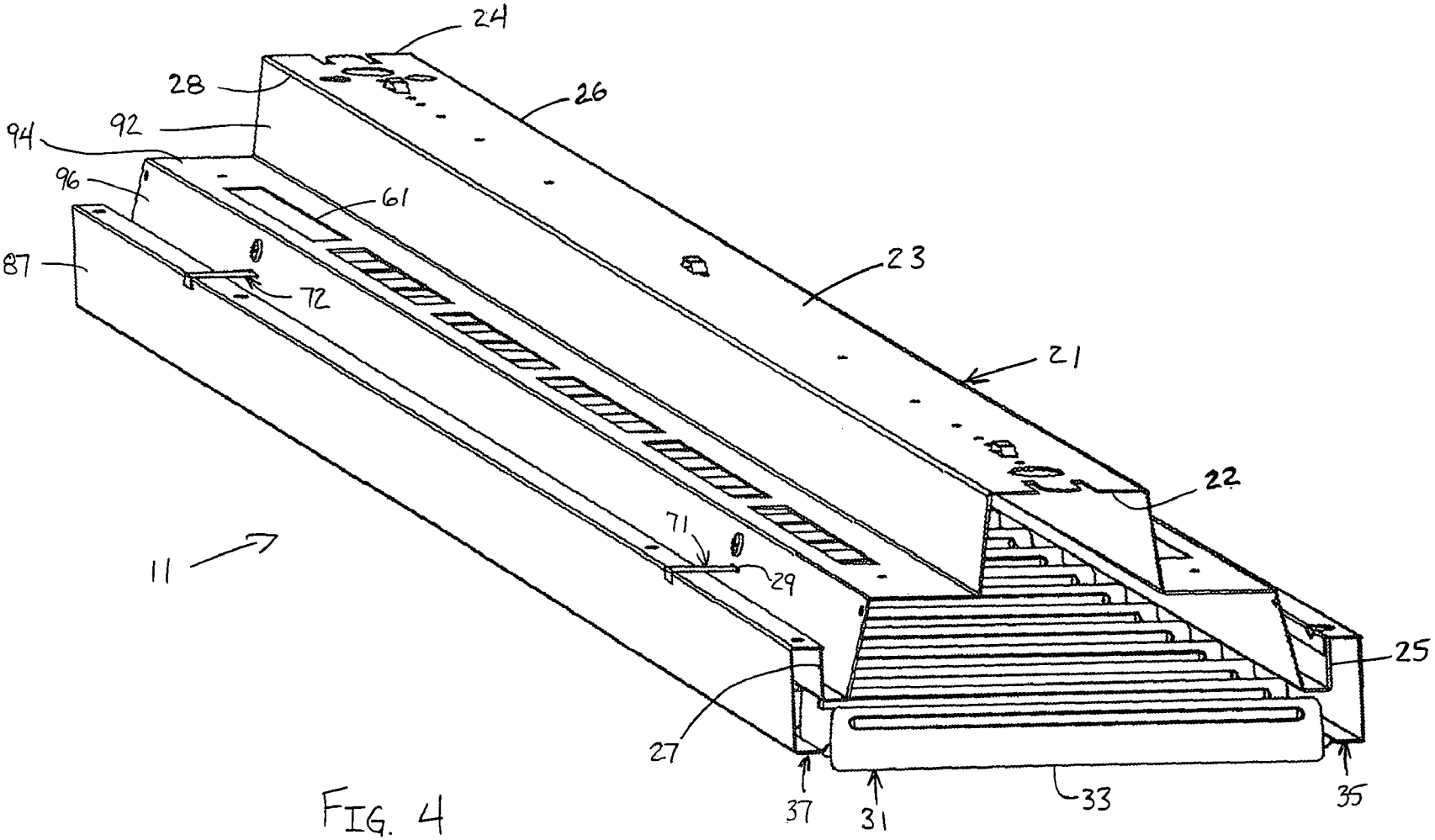
FIG. 4 is a perspective view of the lighting fixture of FIG. 3, showing the latch spring securing the louver assembly to the housing.
Figure 5:
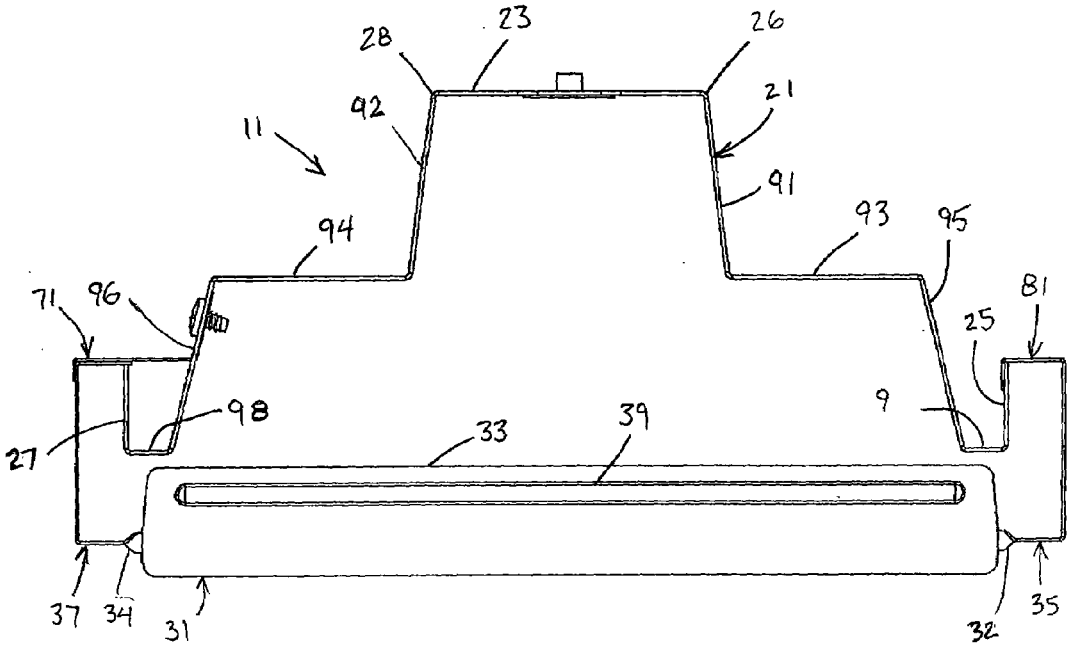
FIG. 5 is a front elevational view of the lighting fixture of FIG. 3.
Figure 7:
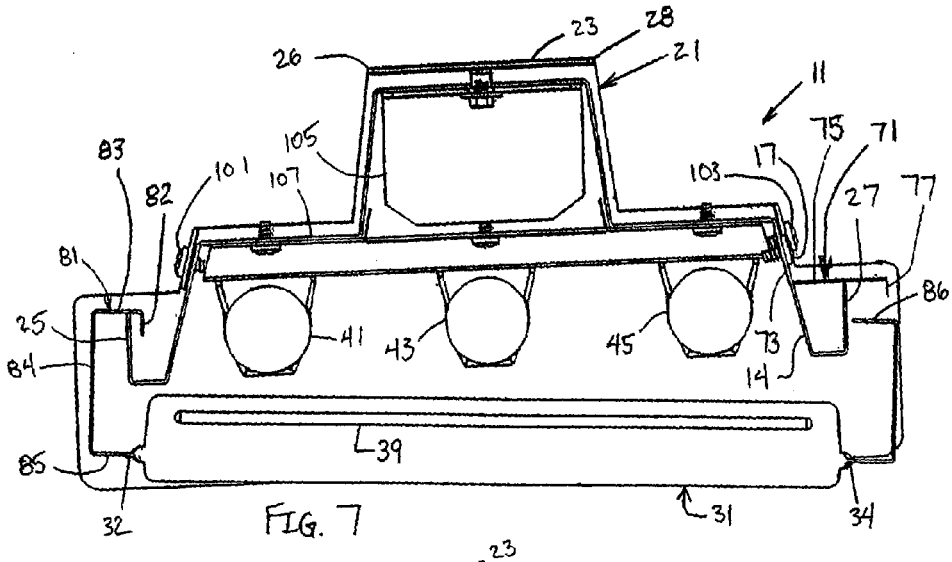
FIG. 7 is a front elevational view of the lighting fixture of FIG. 1 with the front end cap removed, showing the louver assembly connected to a housing wall.
Figure 8:
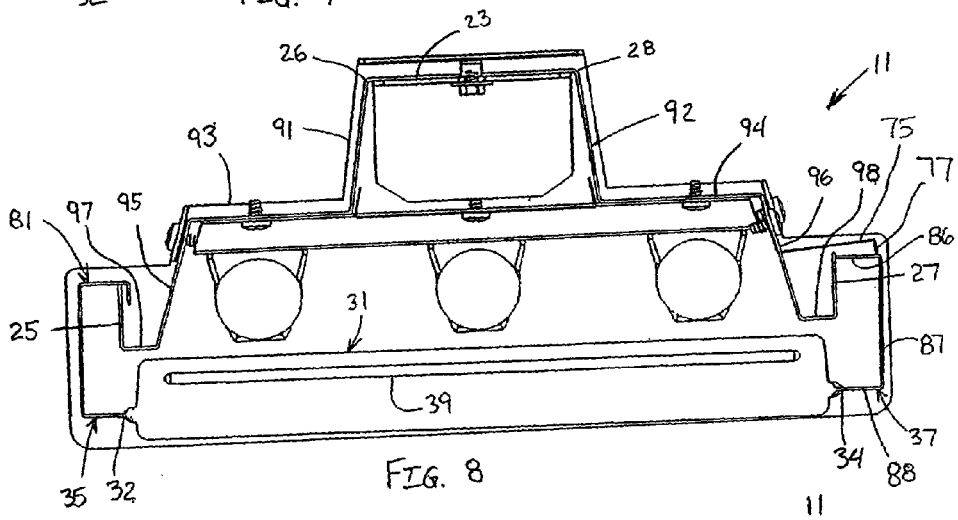
FIG. 8 is a front elevational view of the lighting fixture of FIG. 7, showing the louver assembly contacting the spring latch.
Figure 9:
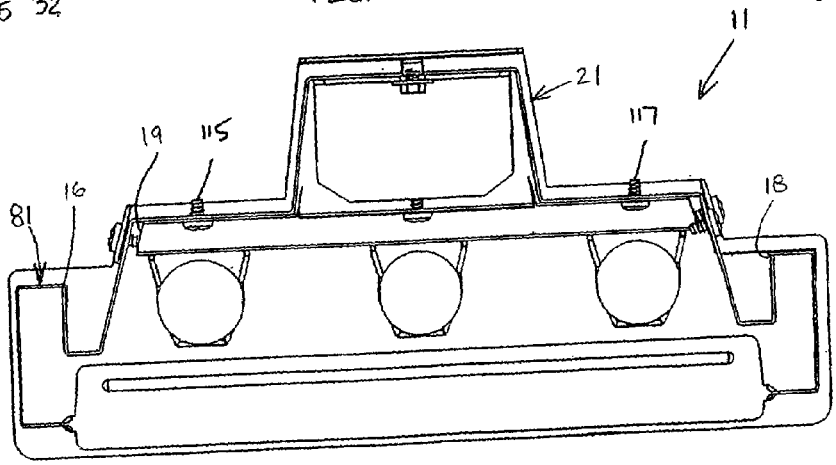
FIG. 9 is a front elevational view of the lighting fixture of FIG. 7, showing the louver assembly secured to the housing by the spring latch.

At least one spring latch 71 is adapted to be connected to the housing 21, as shown in FIGS. 3–5 and 7–9. Any suitable number of spring latches 71 may be used to secure the louver assembly 31 to the housing 21. For example, an embodiment shown in FIGS. 3–5 and 7–9, the housing 21 has first and second spring latches 71 and 72 to secure the louver assembly 31 to the housing. Preferably, as shown in FIGS. 5 and 7–9, the spring latch 71 is connected to an inner surface of the housing 21. Slots 29, as shown in FIG. 4, in the housing 21 allow the spring latch 71 to pass through the wall member 96. Preferably, the spring latch 71 has a first leg 77 and a second leg 75 at a distal end, as shown in FIG. 7. A fastener 17 secures the third leg 73 of the of the spring latch 71 to an inner surface 14 of the housing 21. Preferably, the fastener 17 secures the third leg to the inner surface 14 of wall member 96, as shown in FIGS. 7–9. Preferably, the first leg 77 of the spring latch 71 is substantially perpendicular to the second leg 75.

Lamps 41, 43 and 45, as shown in FIGS. 7–9, are supported within the housing 21 by a support member 19, such as a socket pan. Although three lamps are shown, any suitable number of lamps may be used. Fasteners 115 and 117 secure the support member 19 to the housing 21. Preferably the support member 19 is secured between wall members 95 and 96. A ballast 105 is secured between an upper surface 107 of the support member 19 and the top wall 23 of the housing 21.

A plurality of openings 61 may be disposed in the housing 21 to provide uplighting for the lighting fixture 11, as shown in FIG. 1. Preferably, the uplight openings 61 are substantially rectangular. The uplight openings 61 are provided in the housing above the lamps to provide uplighting. Preferably, the openings 61 are disposed in the wall members 93 and 94 above the lamps 41, 43 and 45. Preferably, approximately 15 percent of the light emitted by the lamps is uplight. The uplight openings 61 allow light from the lamps to shine therethrough away from an opening 12 between first and second walls 25 and 27 of the housing 21.

Assembly and Operation

Referring to FIGS. 1–9, the lighting fixture 11 of the present invention is suspended from a support in any suitable manner, such as is disclosed in U.S. patent Ser. No. 10/815,993 for an "Electrical Lighting Fixture with Suspension Assembly" to Brondt et al., filed Apr. 2, 2004, which is hereby incorporated by reference in its entirety. End caps 51 and 53 are secured to opposite ends of the housing 21 by fasteners 101 and 103 and 102 and 104, respectively.

Once the lighting fixture 11 has been secured to a support, the louver assembly 31 may be secured to the housing 21. The louver assembly may also be secured to the housing 21 before the lighting fixture is secured to the support.

Installation and removal of the louver assembly 21 is shown in FIGS. 7–9. The hook 81 of the first louver arm 35 is connected to the first wall 25 of the housing 21, as shown in FIG. 7. The hook 81 allows the louver assembly 31 to pivot about the connection between the first louver arm 35 and the first housing wall 25. The first leg 82 of the first louver arm 35 prevents the louver assembly 31 from being disconnected from the housing 21. An installer may simply lift the first louver arm 35 upwardly until the first leg 82 clears the first housing wall when removal of the louver assembly 31 is desired.

Once the first louver arm 35 has been pivotally connected to the first housing wall 25, the louver assembly 31 is pivoted upwardly, as shown in FIG. 8. Initially, the second leg 75 of the spring latch 71 is resting on the upper surface 18 of the second housing wall 27, as shown in FIG. 7. As the louver assembly 31 is pivoted upwardly the first leg 86 of the second louver arm 37 contacts the first leg 77 of the spring latch 71, as shown in FIG. 8. Continued upward pivoting of the louver assembly 31 further displaces the spring latch 71 upwardly.

The louver assembly 31 is pivoted upwardly until the first leg 86 of the second louver arm 37 clears the second wall 27 of the housing 21, as shown in FIG. 9. Once the first leg 86 of the second arm 37 clears the upper surface 18 of the second wall 27, the resiliency of the second arm 37 causes the second arm to move inwardly so that the first leg 86 of the second arm is resting on the upper surface 18 of the second wall 27 of the housing. The resiliency of the spring latch 71 causes the spring latch to move downwardly so that the first leg 77 of the spring latch is positioned adjacent the second leg 87 of the second arm 37 and the second leg 75 of the spring latch is positioned adjacent the first leg 86 of the second arm 37 and the upper surface 18 of the second wall 27 of the housing 21, thereby securing the louver assembly 31 to the housing 21.

The louver assembly 31 may be secured to and removed from the housing 21 while the first and second end caps 51 and 53 are secured to the housing. To remove the louver assembly 31 from the housing 21, the first leg 77 of the spring latch 71 is pushed upwardly until it clears the first leg 86 of the second arm 37. The second arm 37 is then pulled outwardly away from the second wall 27 of the housing 21 until the first leg 86 of the second arm clears the second wall of the housing. The louver assembly 31 may then be pivoted downwardly about the connection between the first louver arm 35 and the first wall 25 of the housing 21. The connection between the first louver arm 35 and the first wall 25 of the housing 21 allows maintenance of the lighting fixture 11 to be accomplished without having to remove the louver assembly 31 from the lighting fixture. The louver assembly 31 is also easily installed and removed without requiring any tools.

While a particular embodiment has been chosen to illustrate the invention, it will be understood by those skilled in the art that various changes and modifications can be made therein without departing from the scope of the invention as defined in the appended claims.

What is claimed is:

1. A lighting fixture, comprising:

a housing having a first wall and second wall and an opening between said first and second walls;

at least one spring latch connected to said housing; and a louver assembly having a plurality of louver blades, a first end of said plurality of louver blades being attached to a first arm and a second end of said plurality of louver blades being attached to a second arm, said first arm being connected to said first housing wall and said second arm being secured between said second housing wall and said at least one spring latch, said at least one spring latch being connected to said housing before said second arm is secured between said second housing wall and said at least one spring latch.

2. A lighting fixture according to claim 1, wherein said second arm of said louver assembly is secured between said second housing wall and first and second spring latches.

3. A lighting fixture according to claim 1, wherein said at least one spring latch is secured to an interior surface of the housing.

4. A lighting fixture according to claim 3, wherein said at least one spring latch extends through a slot in the housing.

5. A lighting fixture according to claim 1, wherein said first arm has a first hook at a distal end adapted to pivotally secure said louver assembly to said housing.

6. A lighting fixture according to claim 1, wherein said second arm has a first leg and a second leg, and said spring latch has a first leg and second leg, said second arm first leg being secured between an upper surface of said second wall and said spring latch second first leg and said spring latch first leg being adjacent said second arm second leg.

7. A lighting fixture according to claim 1, wherein a first end cap engages first ends of said first and second housing walls and a second end cap engages second ends of said first and second housing walls.

8. A lighting fixture according to claim 7, wherein at least one lamp extends between said first and second end caps.

9. A lighting fixture according to claim 1, wherein said housing has a plurality of elongated slots positioned above said at least one lamp adapted to allow light from said at least one lamp to shine therethrough away from said opening of said housing.

10. A lighting fixture, comprising:

a housing having a first wall and second wall and an opening between said first and second walls, said first and second walls having upper surfaces;

at least one spring latch connected to said housing, said at least one spring latch having a first leg and a second leg at a distal end; and a louver assembly having a plurality of louver blades positioned below said housing opening, a first end of said plurality of louver blades being attached to a first arm and a second end of said plurality of louver blades being attached to a second arm, said first arm having a hook at a distal end and said second arm having a first leg and a second leg at a distal end, said hook of said first arm being pivotally connected to said first housing wall and said second arm first leg being secured between said upper surface of said second housing wall and said at least one spring latch second leg and said second arm second leg being adjacent said at least one spring latch first leg.

11. A lighting fixture according to claim 10, wherein said at least one spring latch is secured to an interior surface of the housing.

12. A lighting fixture according to claim 11, wherein said at least one spring latch extends through a slot in the housing.

13. A lighting fixture according to claim 11, wherein a first end cap engages first ends of said first and second housing walls and a second end cap engages second ends of said first and second housing walls.

14. A lighting fixture according to claim 13, wherein at least one lamp extends between said first and second end caps.

15. A lighting fixture according to claim 10, wherein said housing has a plurality of elongated slots positioned above said at least one lamp adapted to allow light from said at least one lamp to shine therethrough away from said opening of said housing.

16. A lighting fixture according to claim 10, wherein said hook includes first, second and third legs, said first and second legs being substantially perpendicular and said second and third legs being substantially perpendicular.

17. A lighting fixture according to claim 10, wherein said second arm first leg is substantially perpendicular to said second arm second leg.

18. A lighting fixture according to claim 10, wherein said at least one spring latch first leg is substantially perpendicular to said at least one spring latch second leg.

19. A lighting fixture according to claim 10, wherein said second arm of said louver assembly is secured between said upper surface of second housing wall and first and second spring latches.

20. A method of securing a louver assembly to a lighting fixture, comprising the steps of:

hooking a first arm of the louver assembly to a first wall of a housing of the lighting fixture;

pivoting the louver assembly upwardly;

contacting a latch spring connected to the housing with a second arm of the louver assembly;

securing the second arm of the louver assembly to the housing by continuing the upward pivoting of the louver assembly until the second arm of the louver assembly is positioned between a second wall of the housing and the spring latch; and biasing the second arm of the louver assembly against the second wall of the housing to facilitate retention of the second arm between the second wall of the housing and the spring latch.

21. A method according to claim 20, further comprising:

securing a first end cap to a first end of the housing; and securing a second end cap to a second end of the housing.

22. A method according to claim 21, further comprising:

removing the second arm of the louver assembly from the lighting fixture without requiring tools, including the steps of pushing the spring latch upwardly away from the louver assembly;

pulling the second arm of the louver assembly in a direction away from the first arm of the louver assembly once the spring latch has been lifted above the second arm; and pivoting the louver assembly downwardly to provide access to an interior of the lighting fixture.

23. A method according to claim 22, further comprising:

removing the second arm of the louver assembly from the lighting fixture housing without removing the first and second end caps.

* * * * *